US011203057B2

(12) United States Patent
Matsumoto et al.

(10) Patent No.: US 11,203,057 B2
(45) Date of Patent: Dec. 21, 2021

(54) MOLD CASTING DEVICE

(71) Applicant: HONDA MOTOR CO., LTD., Tokyo (JP)

(72) Inventors: Satoshi Matsumoto, Tokyo (JP); Junji Sugimoto, Tokyo (JP); Yohei Shimokawa, Tokyo (JP); Tomoharu Ogawa, Tokyo (JP); Kazuyuki Tsukamoto, Tokyo (JP); Shinsuke Fujiyama, Tokyo (JP); Toshiya Iwamoto, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/760,288

(22) PCT Filed: Oct. 18, 2018

(86) PCT No.: PCT/JP2018/038857
§ 371 (c)(1),
(2) Date: Apr. 29, 2020

(87) PCT Pub. No.: WO2019/093093
PCT Pub. Date: May 16, 2019

(65) Prior Publication Data

US 2020/0254509 A1 Aug. 13, 2020

(30) Foreign Application Priority Data

Nov. 10, 2017 (JP) ..... JP2017-217398

(51) Int. Cl.
*B22C 9/06* (2006.01)
*B22D 17/26* (2006.01)
(Continued)

(52) U.S. Cl.
CPC ..... *B22C 9/062* (2013.01); *B22C 15/08* (2013.01); *B22D 17/266* (2013.01); *B22D 18/02* (2013.01); *B22D 18/04* (2013.01)

(58) Field of Classification Search
CPC ..... B22D 18/02; B22D 18/04; B22C 9/062
See application file for complete search history.

(56) References Cited

U.S. PATENT DOCUMENTS 4,286,648 A 9/1981 Takeshima et al.
6,772,819 B2 8/2004 Shiose et al.
(Continued)

FOREIGN PATENT DOCUMENTS

CN 101652207 A 2/2010
CN 203817343 U 9/2014
(Continued)

OTHER PUBLICATIONS

Machine Translation of CN 205763681 U (published Dec. 7, 2016, cited in IDS filed Apr. 23, 2021) (Year: 2016).*
(Continued)

*Primary Examiner* — Kevin E Yoon
*Assistant Examiner* — Jacky Yuen
(74) *Attorney, Agent, or Firm* — Rankin, Hill & Clark LLP

(57) ABSTRACT

The present invention provides a mold casting device including a raising and lowering mechanism that raises and lowers the upper mold; a die plate that is fixed to the upper mold; and a base member that is provided on upper end portions of the raising and lowering mechanism and supports the die plate from below.

2 Claims, 5 Drawing Sheets

(51) Int. Cl.

| | |
|---|---|
| ***B22D 18/02*** | (2006.01) |
| ***B22D 18/04*** | (2006.01) |
| ***B22C 15/08*** | (2006.01) |

(56) References Cited

U.S. PATENT DOCUMENTS

| | | | | |
|---|---|---|---|---|
| 2002/0195224 | A1* | 12/2002 | Shiose | B22D 18/06 164/119 |
| 2007/0199675 | A1 | 8/2007 | Tamura et al. | |
| 2010/0051224 | A1 | 3/2010 | Shiose et al. | |
| 2019/0155247 | A1* | 5/2019 | Sato | G05B 19/402 |

FOREIGN PATENT DOCUMENTS

| | | | | |
|---|---|---|---|---|
| CN | 104785749 | A | 7/2015 | |
| CN | 205732908 | U | 11/2016 | |
| CN | 205763681 | U | 12/2016 | |
| GB | 1338744 | A * | 11/1973 | B22D 18/04 |
| IT | 1128974 | B | 6/1986 | |
| JP | H06-29746 | U | 4/1994 | |
| JP | 2003-071554 | A | 3/2003 | |
| JP | 2004-344943 | A | 12/2004 | |
| JP | 3712194 | B2 | 11/2005 | |
| JP | 2009-208131 | A | 9/2009 | |
| JP | 4379621 | B2 | 12/2009 | |
| KR | 20080092251 | A | 10/2008 | |
| WO | 2005/099932 | A1 | 10/2005 | |

OTHER PUBLICATIONS

International Search Report by ISA/JP dated Dec. 11, 2018, on PCT/JP2018/038857, 5 pages.

Written Opinion by ISA/JP dated Dec. 11, 2018, on PCT/JP2018/038857, 3 pages.

Office Action received in corresponding CN application No. 201880072885.2 dated Apr. 2, 2021 with English translation (13 pages).

* cited by examiner

MOLD CASTING DEVICE

TECHNICAL FIELD

The present invention relates to a mold casting device.

BACKGROUND ART

In general, a mold casting device forms a casting product in a target shape by pouring a melt into a cavity formed between an upper mold and a lower mold and cooling down the melt. Among the conventional mold casting devices, in the case of replacing a mold, there are a device of one type that replaces a mold by moving the mold in a transverse direction (see Patent Literature 1) and a device of the other type that takes out a mold and a die plate by lifting upward by a forklift or the like (see Patent Literature 2).

CITATION LIST

Patent Literature

Patent Literature 1: JP 3712194 B2 (FIGS. 1 and 2)

Patent Literature 2: JP H06-029746 U1 (FIG. 1 and paragraphs [0004] and [0009])

SUMMARY OF INVENTION

Technical Problem

In the mold casting device described in Patent Literature 1, in the case of replacing a mold, a wagon is arranged close to the casting device, and the mold is replaced by being moved in the transverse direction to be placed on the wagon. In this case, the mold casting device has a problem that a wagon space for arranging the wagon around the device is required and a problem that the mold replacement work takes time.

On the other hand, in a mold casting device described in Patent Literature 2, after a lower mold and a fixed plate are detached from each other and a threaded rod and a movable plate are detached from each other, the movable plate and the upper and lower molds are taken out to the outside of the device by being lifted up by a forklift or the like. In this case, since the positional relationship between the upper mold and the lower mold is changed during the mold replacement, there is a problem that, next time when setting the mold in the casting device, it is required to adjust the positional relationship again.

In view of this, the present invention has been invented for solving the above-described problems, and an object thereof is to provide a mold casting device that can replace a mold easily.

Solution to Problem

To solve the above problems, a mold casting device according to the present invention is characterized in that the mold casting device obtains a casting product by pouring a melt into a cavity formed between an upper mold and a lower mold and includes: a raising and lowering mechanism that raises and lowers the upper mold; a die plate that is fixed to the upper mold; and a base member that is provided on upper end portions of the raising and lowering mechanism and supports the die plate from below, in which the die plate is supported by the base member relatively movably with respect to the base member.

Advantageous Effects of Invention

The present invention can provide a mold casting device that can replace a mold easily.

BRIEF DESCRIPTION OF DRAWINGS

FIG. 1A is a front view, and FIG. 1B is a side view;

DESCRIPTION OF EMBODIMENTS

Figure 1B:
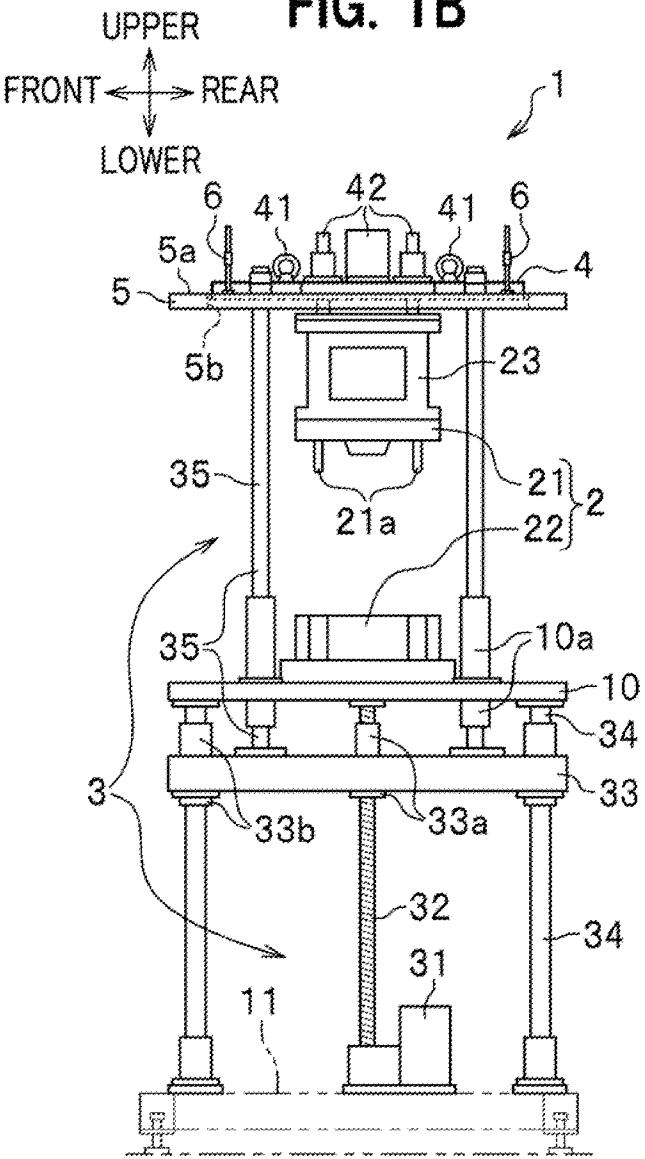
FIGS. 1A and 1B are diagrams showing a mold casting device according to an embodiment of the present invention.

A mold casting device according to an embodiment of the present invention is described with reference to FIGS. 1 to 8.

Note that, in the embodiment of the present invention, a description is given with an example of a case in which an upper mold 21 is moved in the upper and lower directions, and also, for the sake of convenience, the front and rear and the right and left directions in the drawings are described as the upper and lower and the right and left directions.

<<Mold Casting Device>>

Figure 1A:
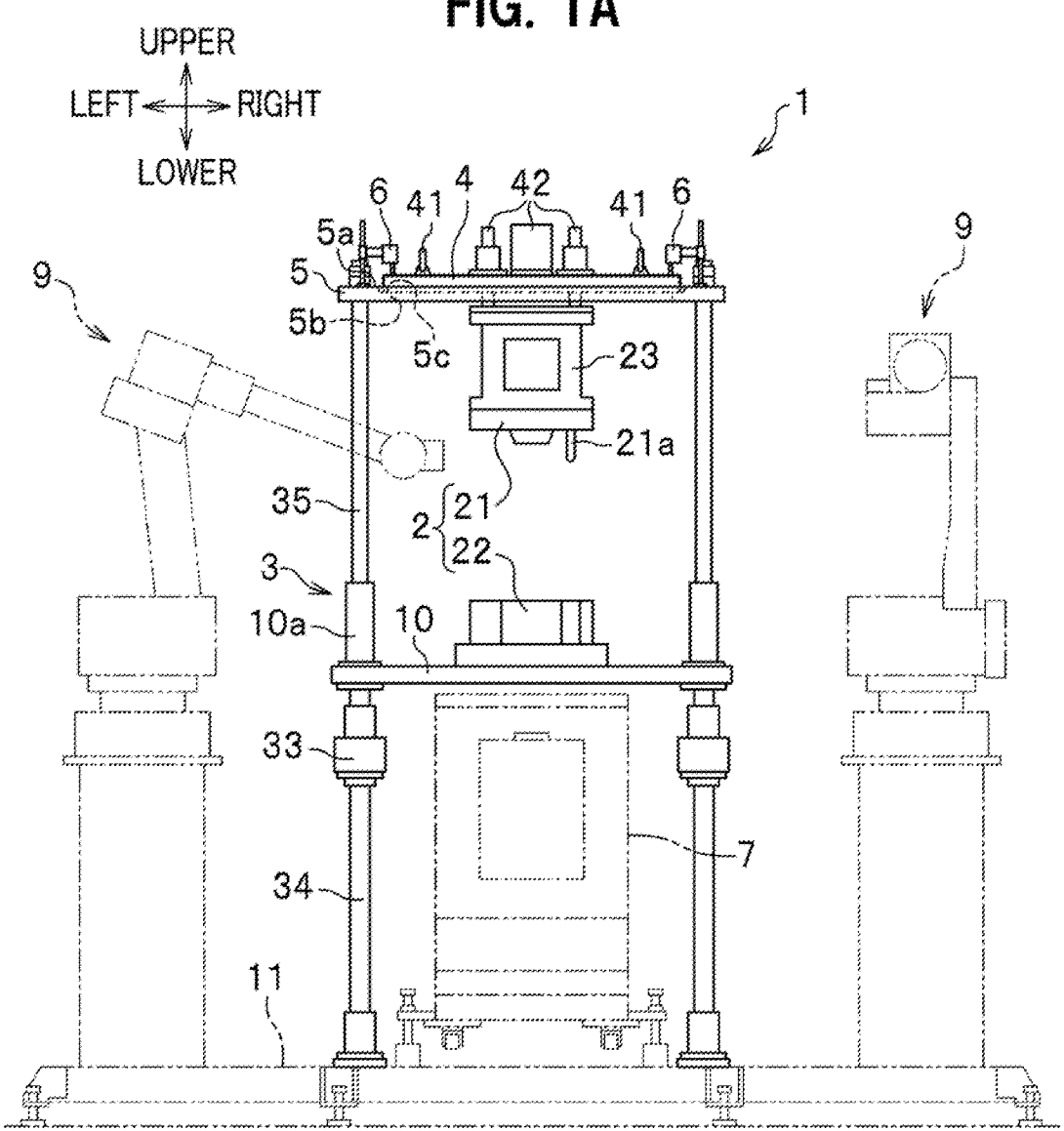

As shown in FIGS. 1A and 1B, a mold casting device 1 is a low pressure casting device that forms a casting product by pouring a melt into a cavity formed between the upper mold 21 and a lower mold 22 of a mold 2 and cooling down the melt. The mold casting device 1 mainly includes the upper mold 21, the lower mold 22, a die plate 4 fixed to the upper mold 21, a base member 5 on which the die plate 4 is placed, a raising and lowering mechanism 3 that raises and lowers the base member 5, gauge heads 6, a holding furnace 7, pull-up devices 8, and robot arms 9.

<<Mold>>

As shown in FIG. 1A, the mold 2 is a mold for casting that includes, for example, the upper mold 21 arranged on the upper side, the lower mold 22 arranged opposite on the lower side of the upper mold 21, and a not-shown core. The mold 2 may be a horizontally split type split into multiple faces, and the shape, configuration, and so on are not particularly limited. In the casting, the cavity in the mold 2 is supplied with a melt of aluminum or the like from the holding furnace 7 arranged below the mold 2.

The upper mold 21 is formed of a movable mold that can be raised and lowered with respect to the lower mold 22 by the raising and lowering mechanism 3. In the upper mold 21, positioning pins 21*a* that are engaged with positioning holes 22*a* formed in the lower mold 22 (see FIG. 3) and the (not shown) core and an upper mold cavity for forming an upper half body of the cast product are formed. The upper mold 21 is fixed to a lower surface of the die plate 4 with an upper mold attachment frame body 23 arranged therebetween. The positioning pins 21*a* are provided to project downward from a lower surface of the upper mold 21.

The lower mold 22 is formed of a fixed mold that is placed and fixed on a lower die plate 10. The lower mold 22 includes a not-shown lower mold cavity for forming a lower half body of the cast product. Additionally, on the lower surface of the upper mold 21 and an upper surface of the lower mold 22, a positioning key for adjusting the positions and a recess portion that can adjust the positions of the upper mold 21 and the lower mold 22 automatically by being engaged with the positioning key are arranged opposite to each other.

The upper mold attachment frame body 23 is a member in which the upper mold 21 is fixed to a lower surface and the die plate 4 is fixed to an upper surface. The upper mold attachment frame body 23 is formed by assembling frame members in the form of a turret. On an upper side surface of the upper mold attachment frame body 23, a (not shown) hose holding member for attaching multiple hoses supplying cooling water for cooling down the mold is provided to project in the horizontal direction.

Note that, the upper mold attachment frame body 23 shown in FIG. 1A may be fixed in any form as long as the upper mold attachment frame body 23 is fixed to the die plate 4, and the upper mold attachment frame body 23 may be indirectly fixed to the lower surface of the die plate 4 with an extrusion mechanism 42 arranged therebetween, or may be fixed directly to the lower surface of the die plate 4.

<<Die Plate>>

The die plate 4 is an upper mold platen that holds the upper mold 21 in a state of being hung from the top. The die plate 4 is supported by the base member 5 so as to be relatively movable with respect to the base member 5. The die plate 4 is provided with hanging portions 41 coupled to the pull-up devices 8 for pulling up the die plate 4 (see FIGS. 2A and 2B), the extrusion mechanism 42 for extruding the casting product in the mold 2, and the upper mold attachment frame body 23. The die plate 4 is formed of a plate-shaped member made of metal.

Figure 5:
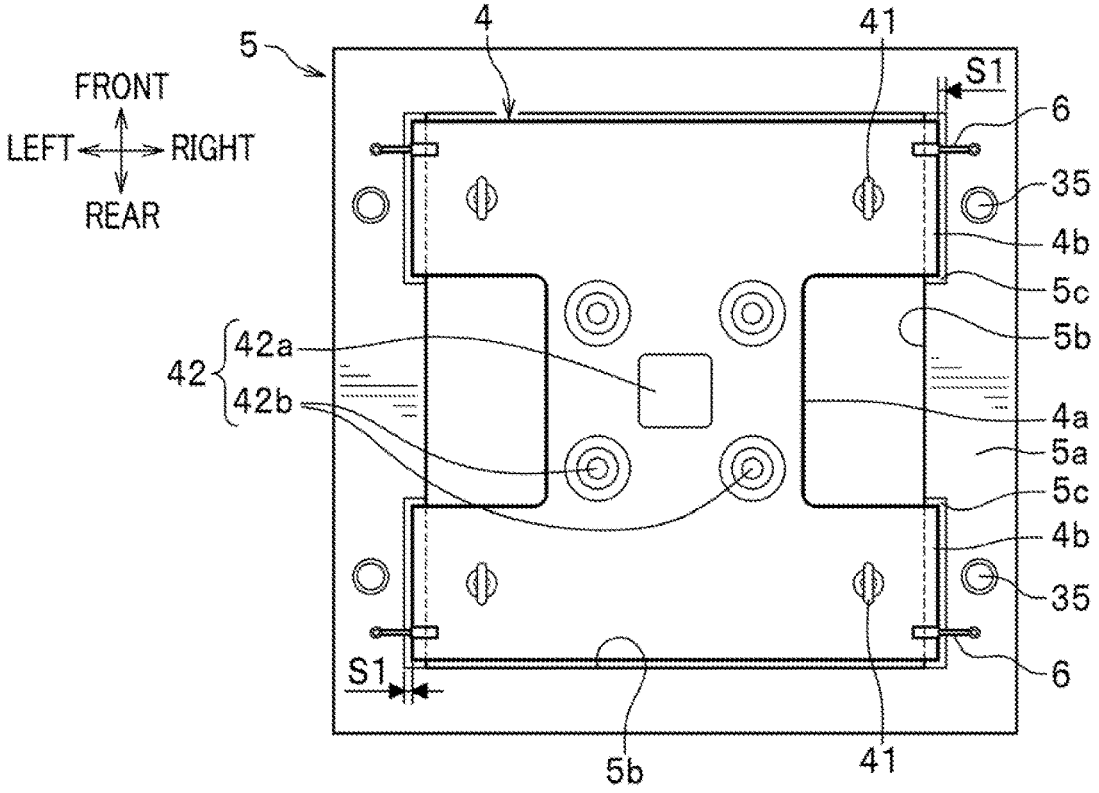
FIG. 5 is an enlarged plan view of the mold casting device.

As shown in FIG. 5, as an example, the die plate 4 includes notch portions 4*a* formed in right and left middle portions and engagement portions 4*b* protruding in the right and left directions from front and rear end portions on the right and the left. Thus, the die plate 4 is formed in a substantially H shape in plan view. The upper mold 21 is fastened to the die plate 4 from the above with the upper mold attachment frame body 23 arranged therebetween (see FIGS. 2A and 2B).

The notch portions 4*a* are parts that allow the (not shown) multiple hoses for the cooling water to be arranged so that the hoses are inserted therein.

The engagement portions 4*b* are parts to be placed on step portions 5*c* of the base member 5, which allow the upper mold 21 coupled to the die plate 4 to be placed so as to be hung by the base member 5.

Figure 2A:
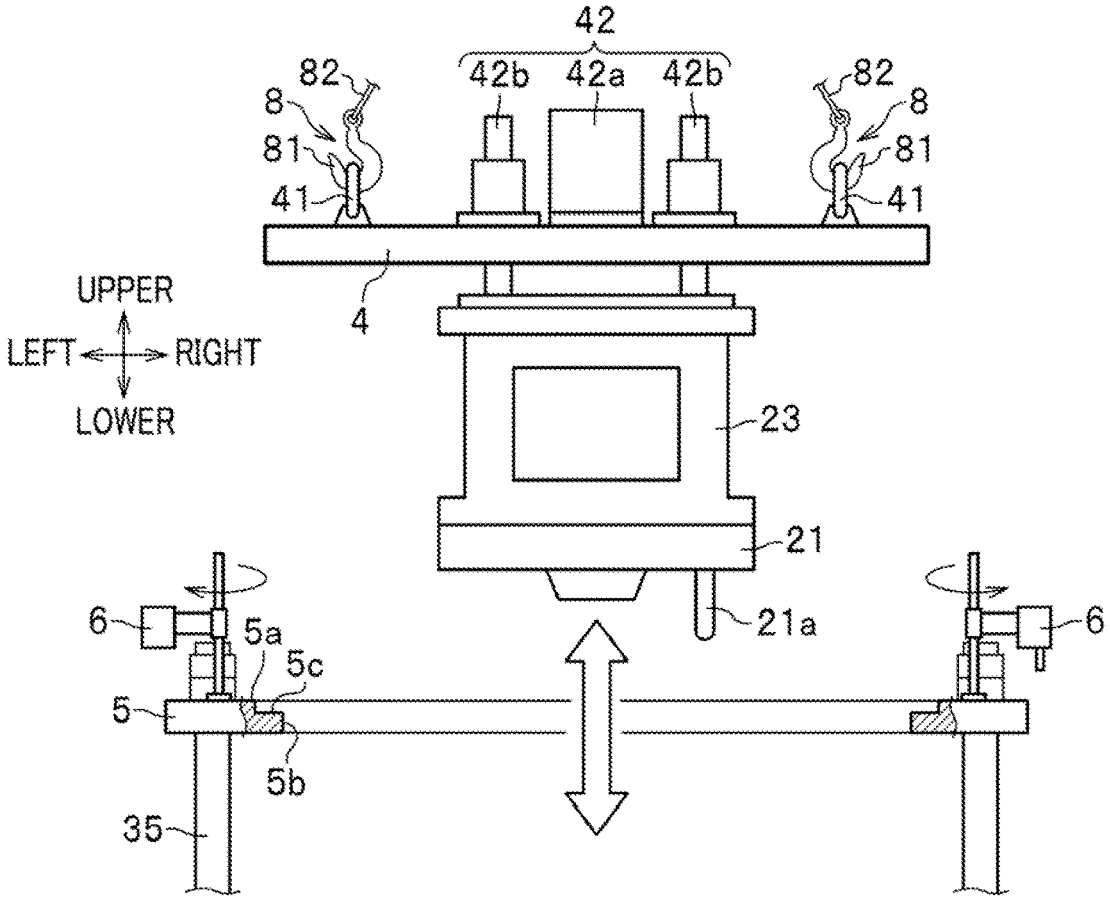
FIG. 2A is a main part enlarged front view showing a state in which a die plate is about to be placed on a base member.
Figure 2B:
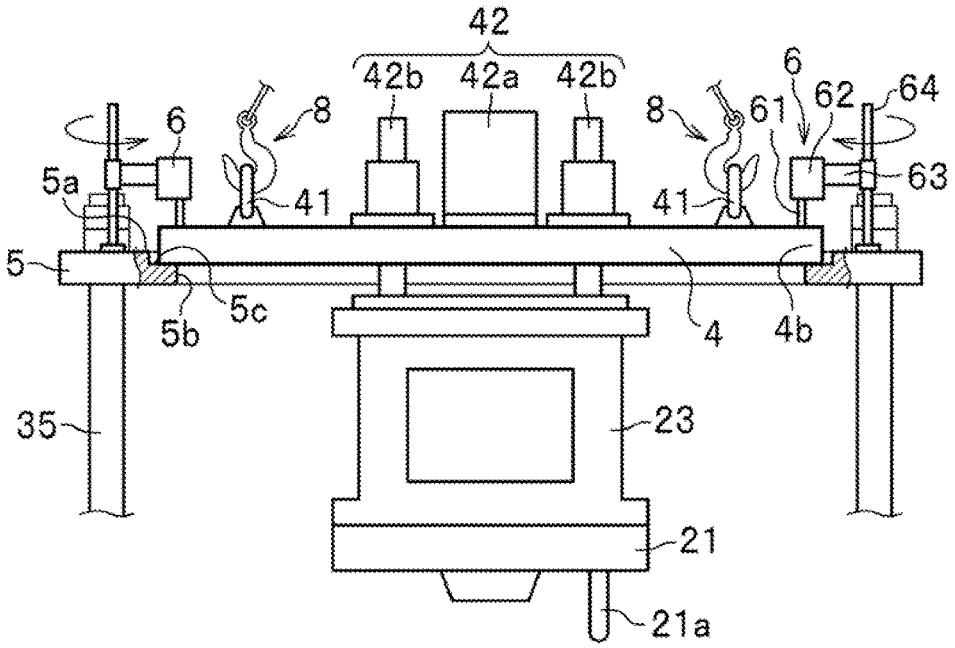
FIG. 2B is a main part enlarged front view showing a state in which the die plate is placed on the base member.

As shown in FIGS. 2A and 2B, the hanging portions 41 are parts over which hooks 81 of the pull-up devices 8 formed of a crane or the like are hooked. The hanging portions 41 are formed of metallic rod-shaped members processed in a ring shape or in an inverted U shape that are provided on an upper surface of the die plate 4. The hanging portions 41 are, for example, provided in four sections in the front, rear, right, and left on the upper surface of the die plate 4 (see FIG. 5).

The extrusion mechanism 42 is, for example, a device for pushing and detaching the casting product from the mold 2. The extrusion mechanism 42 includes a hydraulic cylinder device 42*a* including a (not shown) piston and multiple detachment pins 42*b* moved back and forth by the extrusion mechanism 42.

<<Raising and Lowering Mechanism>>

As shown in FIG. 1B, the raising and lowering mechanism 3 is a raising and lowering device for raising and lowering the base member 5. The raising and lowering mechanism 3 is formed of, for example, an electric raising and lowering device including electric motors 31, male thread members 32, rising and lowering frames 33, sliding guides 34, and guide support poles 35. The raising and lowering mechanism 3 is configured so that the entire facility has a low height with the electric motor 31 as a driving source placed on a base table 11 in a lower part of the mold casting device 1.

The electric motors 31 are, for example, each formed of an AC servomotor or the like capable of a high resolution and highly responsive positioning operation with a rotation detection unit (encoder) mounted on a counter output shaft side of the electric motor 31 to detect the position and the rotation rate of a rotor.

The male thread members 32 are rotation members that are rotated and driven by the electric motors 31, respectively. The male thread members 32 each include a male thread portion (formed of a ball screw, for example) on an outer peripheral surface of a column-shaped pole member provided to extend upward.

The rising and lowering frames 33 are a right and left pair of beam-shaped members that rise and lower as the male thread member 32 pivots. The rising and lowering frames 33 are each provided with a female thread portion 33*a* to be screwed to the male thread portion of the male thread member 32 to allow the rising and lowering frame 33 to rise and lower, cylindrical portions 33*b* in which the sliding guides 34 are inserted respectively, and the guide support poles 35. The rising and lowering frame 33 functions as a coupling member that couples the female thread portion 33*a*, which rises and lowers as the male thread member 32 pivots, and the guide support poles 35 on which the base member 5 is placed, so that the female thread portion 33*a* and the guide support poles 35 rise and lower in conjunction with each other.

The female thread portion 33*a* is formed of a tubular member fixed in the center portion of the rising and lowering frame 33. A female thread is formed on an inner surface of the female thread portion 33*a*.

The cylindrical portions 33*b* are cylindrical members that are fitted on the sliding guides 34 slidably in the upper and lower directions, respectively. The cylindrical portions 33*b* are fixed in the front and rear end portions of the rising and lowering frame 33.

The sliding guides 34 are members that function as guide members for guiding the rising and the lowering of the rising and lowering frame 33 and function as poles supporting the lower die plate 10 from below. The sliding guides 34 are formed of four column-shaped support poles provided to stand in the front, rear, right, and left on the base table 11. The lower die plate 10 is provided to be placed on upper ends of the sliding guides 34.

The guide support poles 35 are pole-shaped members each includes a lower end provided to stand on the rising and lowering frame 33 and an upper end fastened to the base member 5. The guide support poles 35 are formed of four column-shaped members provided to extend in the upper and lower directions from the top of the lower die plate 10. The guide support poles 35 are configured to raise and lower the base member 5 by rising and lowering integrally with the rising and lowering frame 33 as the rising and lowering frame 33 rises and lowers.

A lower die plate 10 is a thick plate member that is a quadrate in plan view and placed horizontally on the male thread members 32 and the sliding guides 34. The lower mold 22 is placed on the lower die plate 10. In the front, rear, right, and left of the lower die plate 10, tubular portions 10*a* that support the guide support poles 35 with the guide support poles 35 inserted movably upward and downward are provided toward the upper and lower directions, respectively.

<<Base Member>>

Figure 6:
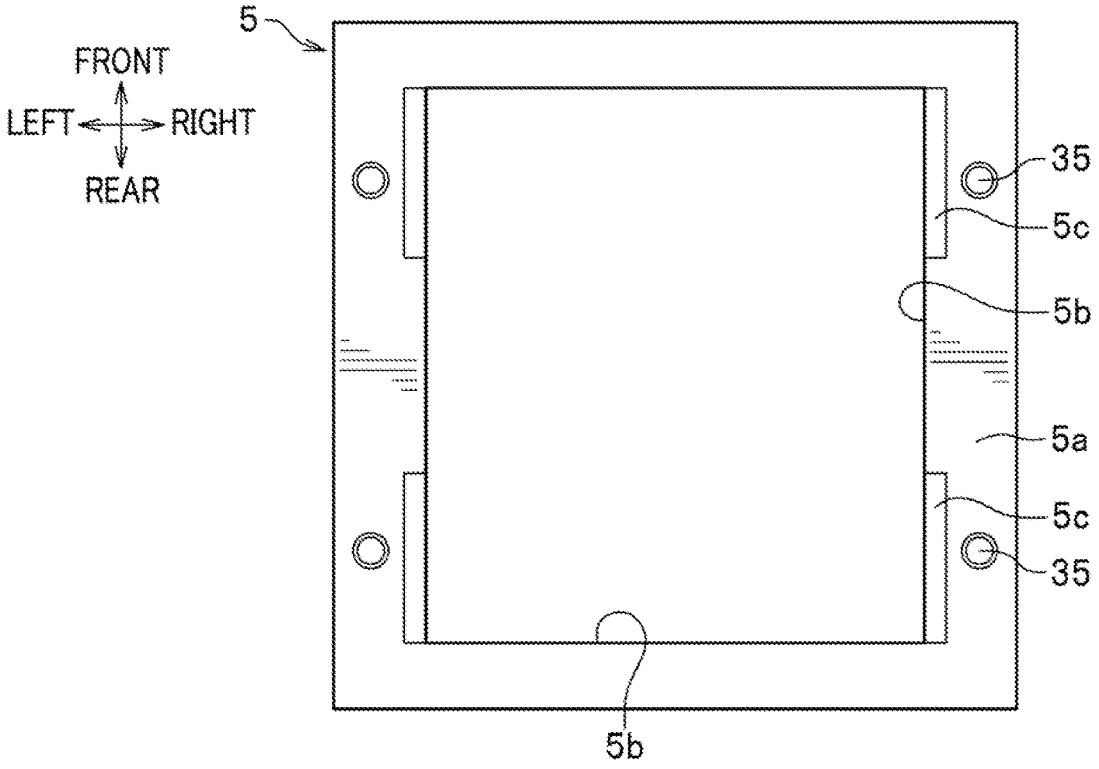
FIG. 6 is an enlarged plan view of the base member.

The base member 5 is formed of a thick plate member in a quadrangular frame shape for supporting the die plate 4 from below (see FIG. 6). The base member 5 includes the support portion 5*a* that supports the die plate 4, an insertion portion 5*b* through which the upper mold 21 fixed to the die plate 4 is inserted upward and downward, and the step portions 5*c* formed on upper side inner edges of the insertion portion 5*b*.

As shown in FIG. 5, in front portions and rear portions in the right and left directions of the base member 5, the four guide support poles 35 on upper ends of the raising and lowering mechanism 3 (see FIG. 1B) and the four gauge heads are provided. Thus, the base member 5 including the support portion 5*a* and the step portions 5*c* for supporting the die plate and the insertion portion 5*b* in which the upper mold is inserted is supported by the guide support poles 35 and serves as a guide member that restricts the movement of the upper mold 21 in the horizontal direction during the rising and the lowering of the upper mold 21 (see FIGS. 2A and 2B).

The support portion 5*a* is a part in which the die plate 4 is placed and supported on the base member 5. In this embodiment, the support portion 5*a* is formed of the step portions 5*c* formed in four sections in the front, rear, right, and left of the insertion portion 5*b*.

The insertion portion 5*b* is formed of a quadrangular opening formed in the center portion of the base member 5. The step portions 5*c* are step-shaped parts that support the die plate 4 movably by a predetermined range in the horizontal direction.

Clearances S1 are provided between back walls of the step portions 5*c* and the engagement portions 4*b* and between the edges of the insertion portion 5*b* of the base member 5 and edges in the front and rear directions of the die plate 4 such that the die plate 4 can be moved with respect to the base member 5 by a predetermined distance in the front, rear, right, and left directions.

<<Gauge Head>>

As shown in FIGS. 2A and 2B, the gauge heads 6 are gauge devices that gauge a displacement of the die plate 4 due to the thermal expansion of the upper mold 21 (see FIGS. 1A and 1B). The gauge heads 6 are, for example, each formed of a stroke sensor capable of gauging the displacement of the upper mold 21 from the beginning to the completion of the casting in μm and even a microscopic displacement of 1/1000 mm at minimum. The gauge head 6 includes a push rod 61, a sensor main body 62, an arm portion 63, and a sensor support pole 64.

The push rod 61 is formed of a rod-shaped member arranged in a state of protruding from the sensor main body 62. In the push rod 61, a base end portion is biased on a tip end side by a compression spring provided in the sensor main body 62, and the tip end is arranged to put in contact with the upper surface of the die plate 4 during the gauging.

The sensor main body 62 is formed of a variable resistor that converts the back and forth movement of the push rod 61 to a resistance value, or is a chassis in which a hall IC or the like that converts the back and forth movement of the push rod 61 to a voltage value is provided.

The arm portion 63 is a member for holding the sensor main body 62 horizontally and supporting the base end side pivotably about the sensor support pole 64.

The sensor support pole 64 is formed of a rod-shaped member in the column shape that is provided to stand in each of the end portions in the right, the left, the front, and the rear of the upper surface of the base member 5.

<<Holding Furnace>>

As shown in FIG. 1A, the holding furnace 7 is a furnace in which the melt such as aluminum to be poured into the mold 2 is reserved with the melt being warmed. The holding furnace 7 is arranged movably in the center portion on the base table 11.

<<Pull-Up Device>>

As shown in FIG. 2A, the pull-up devices 8 are raising and lowering devices for raising and lowering the die plate 4 fixed to the upper mold 21. The pull-up devices 8 may be any devices as long as the devices are capable of raising and lowering the die plate 4 together with the upper mold 21, and the configuration thereof is not particularly limited. As an example, the pull-up devices 8 are an overhead crane such as a hoist crane. The pull-up devices 8 each include the hook 81 hooked over the hanging portion 41 of the die plate 4 and a hanging rope 82 for hanging up the die plate 4.

<<Robot Arm>>

As shown in FIG. 1A, for example, the two robot arms 9 are arranged around the mold casting device 1. One of the robot arms 9 is a device for taking out the completed casting product from the mold 2, and the other one of the robot arms 9 is a device for taking out the core.

<<Effects>>

Next, effects of the mold casting device 1 according to the embodiment of the present invention are described with reference to FIGS. 1 to 8 in the order of casting steps.

First, as shown in FIG. 2A, the hooks 81 are hooked over the hanging portions 41 on the die plate 4 in which the upper mold 21, the upper mold attachment frame body 23, and the die plate 4 are integral with each other, and the upper mold 21 is hung up by the pull-up devices 8.

Next, as shown in FIG. 2B, the pull-up devices 8 are used to lower the upper mold 21 and the upper mold attachment frame body 23 to insert into the insertion portion 5*b* from the top of the mold casting device 1. Then, the die plate 4 is further lowered so that the engagement portions 4*b* are respectively placed on the corresponding step portions 5*c* (the support portion 5*a*), and thus the die plate 4 is placed on the base member 5 (step of lowering upper mold).

Figure 3:
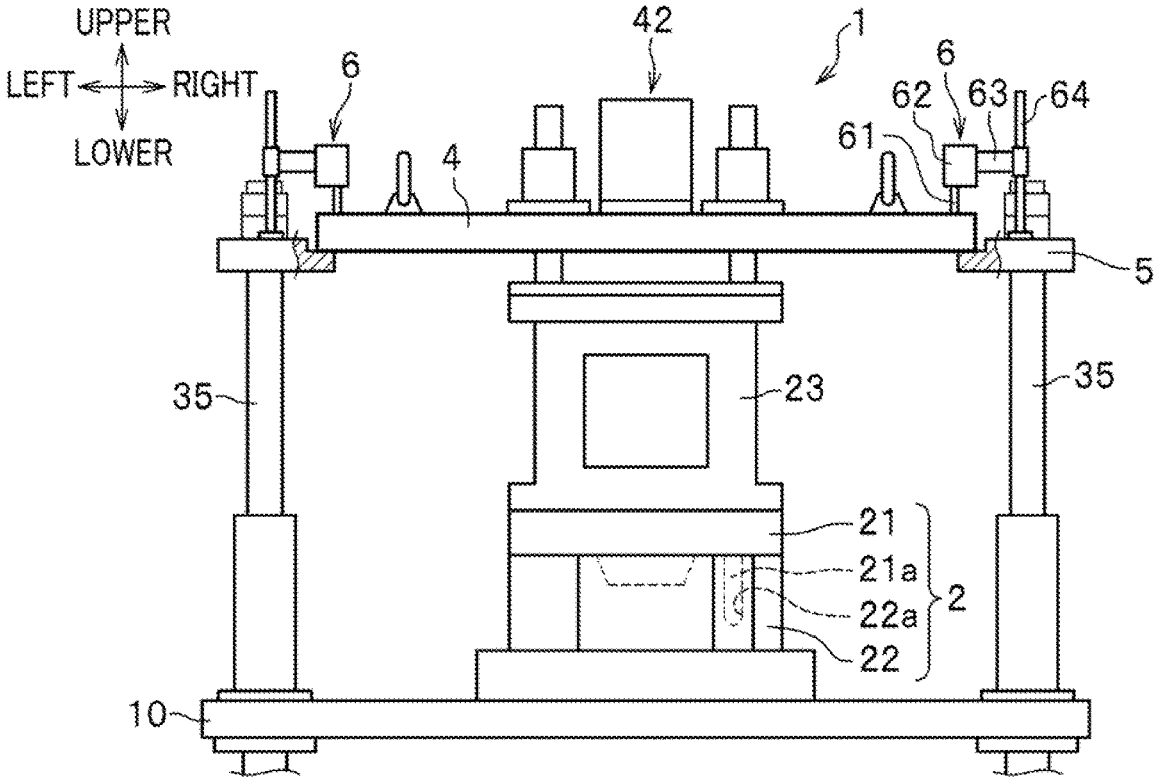
FIG. 3 is a main part enlarged front view of the mold casting device in a state in which an upper mold is placed on a lower mold.

Subsequently, as shown in FIG. 3, the raising and lowering mechanism 3 (see FIG. 1B) is used to lower the base member 5 to insert the positioning pins 21*a* of the upper mold 21 into the positioning holes 22*a* of the lower mold 22 to adjust the positions, and the upper mold 21 is placed on a predetermined position on the lower mold 22 (step of positioning mold). In this process, the upper mold 21 is placed on the lower mold 22, and the mold 2 is closed by the own weights of the upper mold 21, the upper mold attachment frame body 23, the die plate 4, the extrusion mechanism 42, and so on.

As described above, the upper mold 21 is not fixed to the lower mold 22, and the die plate 4 coupled to the upper mold 21 is floatingly supported by the base member 5. Thus, since the die plate 4 and the base member 5 are in a clampless state where the die plate 4 and the base member 5 are not closed by a mold clamp, a bolt, or the like, it is possible to reduce the operation step and improve the productivity. Additionally, since the melt in the cavity is not leaked from the mold 2 although the upper mold 21 and the lower mold 22 are not closed, it is possible to simplify the mold closing configuration.

Moreover, in this process, the positions of the upper mold 21 and the lower mold 22 are adjusted by the positioning pins 21*a*. Consequently, there is no need to release a clamp to adjust the positions.

Figure 4:
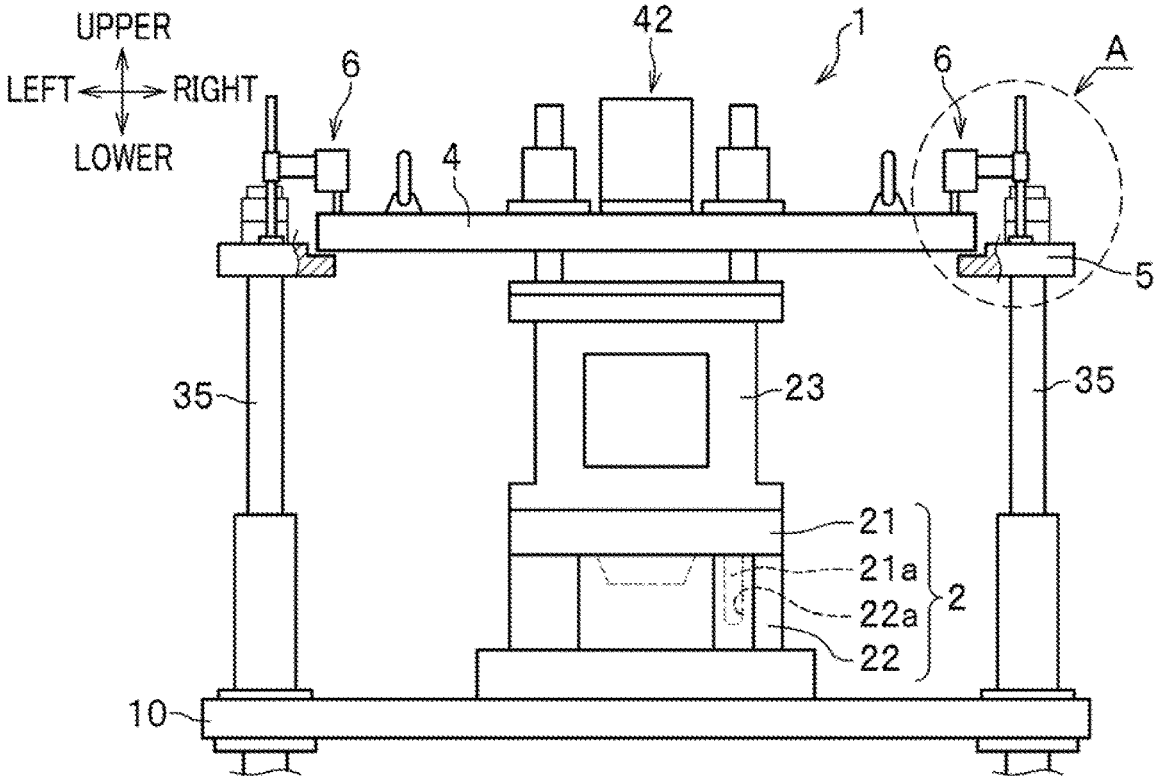
FIG. 4 is a main part enlarged front view of the mold casting device showing a state in which the base member is lowered to be set so as to allow a gauge head to measure the displacement of the die plate.
Figure 7:
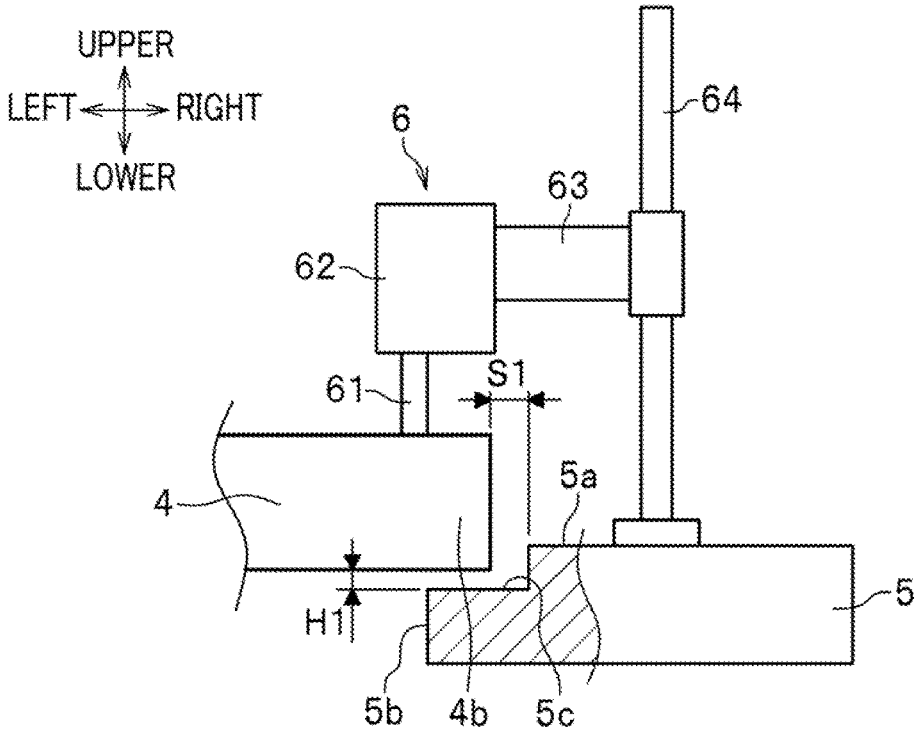
FIG. 7 is an enlarged view of an A section in FIG. 4.

Next, the electric motors 31 of the raising and lowering mechanism 3 shown in FIG. 1B are driven to lower the base member 5 so that the die plate 4 is arranged to be floating at a height H1 (about 10 mm) from upper surfaces of the step portions 5*c* of the base member 5 as shown in FIGS. 4 and 7. Thus, as shown in FIG. 7, the die plate 4 is supported with respect to a side wall of each step portion 5*c* so as to be raised to the height H1 and floating above the upper surface of the step portion 5*c*, and the step portion 5*c* allows the die plate 4 to also be floatingly supported movably by the clearance S1 in the horizontal direction.

Subsequently, as shown in FIGS. 2B and 7, the sensor main body 62 of each gauge head 6 is made pivot toward the die plate 4 about the sensor support pole 64, and the tip end of the push rod 61 is brought into contact with the upper surface of the die plate 4 (step of setting gauge head). This implements a state in which the displacement of the die plate 4 due to the expansion of the mold 2 (see FIG. 4) can be gauged by the gauge heads 6.

The present applicant conducted an experiment of using stroke sensors (the gauge heads 6) to measure a displacement of the die plate 4 with the upper mold 21 floatingly supported.

Consequently, the present applicant found out that there is a significant correlation between a displacement of the stroke sensor being floatingly supported (that is, the thermal expansion of the upper mold 21) and a temperature change in an aluminum melt. Thereby, as shown in FIG. 4, an image of condensation of the melt in the mold 2 could be grasped by measuring a displacement of the die plate 4 being floatingly supported by the stroke sensor. As a result, a detachment timing when the melt is in the optimum state could be obtained.

Next, after the mold 2 is preheated (step of preheating mold), a melt in the holding furnace 7 (see FIG. 1B) is supplied into the mold 2 so that the cavity is filled with the melt (step of supplying melt). Once the mold 2 is supplied with the melt, the heat of the melt is conducted to the mold 2, and the mold 2 is heated. In the casting of the casting product (step of casting), it is desirable to set the temperatures of the melt and the mold 2 to desired temperatures.

Figure 8:
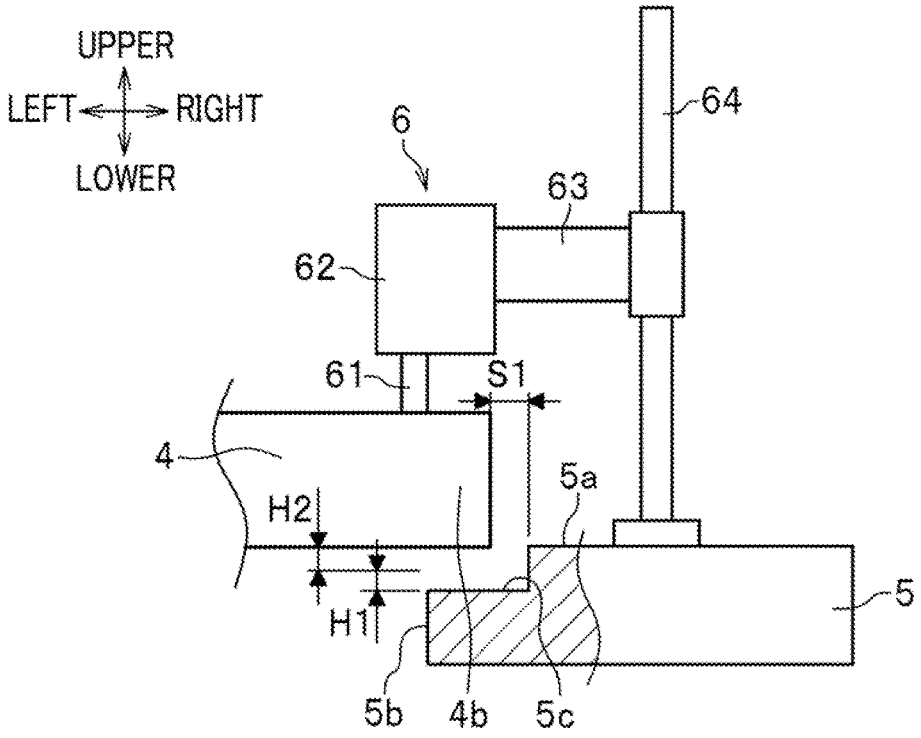
FIG. 8 is a main part enlarged front view showing a state in which the displacement of the die plate is being gauged by the gauge head.

As shown in FIGS. 4 and 8, the mold 2 is expanded by being heated by the melt and displaced. Once the mold 2 is expanded due to the heat of the melt, the die plate 4 and the push rod 61 are pushed up by a height H2 by way of the upper mold attachment frame body 23. As the gauge head 6 is used for gauging the height H2 by which the die plate 4 is raised, it is possible to gauge the expansion of the mold 2 due to the heat of the melt and to indirectly grasp the state of the melt in the mold 2 and the states of the upper mold 21 and the lower mold 22.

Additionally, when the mold 2 and the melt have a decreased temperature by being cooled down with the cooling water and are condensed, the die plate 4 is accordingly lowered with the upper mold 21. Gauging the lowering of the die plate 4 by the gauge heads 6 makes it possible to adequately grasp a timing of the condensation of the casting product and opening of the mold. Conventionally, in the case of gauging the temperature of the aluminum melt, it has been required to provide many temperature sensors in the mold 2, and thus the workability was poor. In contrast, since the gauge heads 6 formed of the stroke sensors can be provided outside the mold 2, it is easy to provide the gauge heads 6.

Next, a confirmation is made to see whether the die plate 4 is lowered to the original position on the step portions 5*c* and the gauge heads 6 are back to the original state as shown in FIG. 4 or 7. Then, when it is confirmed by the gauge heads 6 and the like that the melt in the mold 2 is cooled down and it is the temperature at which the casting product is formed, the upper mold 21 is raised by the pull-up devices 8, and the upper mold 21 is taken out by being moved out from the mold casting device 1 (step of taking out upper mold).

Subsequently, the core and the casting product are taken out by the robot arms 9 shown in FIG. 1A from the lower mold 22 (step of detaching product from mold), and the mold 2 is cleaned up to complete the casting of the casting product by the mold casting device 1.

Additionally, replacement of the upper mold 21 is performed similarly as described above. First, as shown in FIG. 2A, the upper mold 21 is raised by the pull-up devices 8, and the upper mold attachment frame body 23 that includes the used upper mold 21 is removed by being taken out from the mold casting device 1. Next, the upper mold attachment frame body 23 that includes the maintained lower mold 22 may be raised by the pull-up devices 8 to be placed as a replacement on the lower mold 22.

As described above, as shown in FIGS. 1A and 1B, the present invention is the mold casting device 1 that obtains a casting product by pouring a melt into the cavity formed between the upper mold 21 and the lower mold 22 and includes the raising and lowering mechanism 3 that raises and lowers the upper mold 21, the die plate 4 that is fixed to the upper mold 21, and the base member 5 that is provided on the upper end portions of the raising and lowering mechanism 3 and supports the die plate 4 from below, in which the die plate 4 is supported by the base member 5 relatively movably with respect to the base member 5.

Thus, as shown in FIGS. 3 and 4, in the mold casting device 1 according to the present invention, the die plate 4 is supported by the base member 5 relatively movably with respect to the base member 5. With this, when the upper mold 21 is expanded due to the heating by the melt and displaced, the upper mold 21 is raised and floatingly supported with respect to the base member 5. Consequently, since it is possible to perform the mold closing always following the change in the shape of the mold 2 due to the heat generated during the casting cycles, the optimum mold closing position for the mold temperatures changing every second can be secured. Therefore, the present invention can enhance the work efficiency by omitting the positioning works that have been performed to obtain the optimum mold closing every time the temperature of the mold is increased.

Additionally, since the present invention can replace the mold by raising and lowering the die plate 4 with the upper mold 21 by the raising and lowering mechanism 3, it is possible to omit attaching and detaching of a coupling member for attaching the upper mold 21 to the die plate 4. Consequently, the present invention can achieve the enhancement of the efficiency of the replacement work of the mold 2.

Therefore, the present invention can provide the mold casting device 1 that can replace a mold easily.

Moreover, the mold casting device 1 according to the present invention further includes the gauge head 6 that gauges a displacement of the die plate 4 due to the thermal expansion of the upper mold 21.

Consequently, as described above, since the die plate 4 fixed to the upper mold 21 is floatingly supported with respect to the base member 5, the displacement of the die plate 4 can be gauged by the gauge head 6. The gauge head 6 can know the state of the melt as a source of the heat generation by gauging the displacement of the die plate 4 fixed to the upper mold 21 when the upper mold 21 is heated by the melt and displaced due to the thermal expansion.

Furthermore, as shown in FIGS. 2A and 2B, the die plate 4 includes the multiple hanging portions 41 to be coupled with the pull-up devices 8 that pull up the die plate 4.

This allows the pull-up device 8 to raise the die plate 4 fixed to the upper mold 21 upward and lower the die plate 4 fixed to the upper mold 21 into the mold casting device 1 by hooking the hooks 81 or the like over the hanging portions 41. Additionally, since the raising and lowering mechanism 3 (see FIG. 1B) that raises and lowers the upper mold 21 is arranged in the lower part the mold casting device 1 in the present invention, an upper configuration of the mold casting device 1 is simplified, and it is easy to attach and detach the upper mold 21 from the above.

Moreover, the base member 5 includes the support portion 5*a* that supports the die plate 4 and the insertion portion 5*b* through which the upper mold 21 fixed on the die plate 4 is inserted upward and downward.

Consequently, the base member 5 allows the upper mold 21 to be inserted in the insertion portion 5*b* to move upward and downward and also allows the die plate 4 fixed to the upper mold 21 to be supported by the support portion 5*a*. Therefore, the mold casting device 1 can arrange the upper mold 21 in the device from above the device and can enhance the workability of the mold replacement work.

Furthermore, on the upper side inner edge of the insertion portion 5*b*, the step portion 5*c* that supports the die plate 4 movably by a predetermined range in the horizontal direction is formed.

Consequently, since the die plate 4 is supported by the step portion 5*c* movably by a predetermined range in the horizontal direction, it is possible to adjust the position of the die plate 4 when the upper mold 21 is placed on the lower mold 22.

[Modification]

Note that, the present invention is not limited to the above-described embodiment, and various modifications and changes are possible within the scope of the technical idea, and it should be appreciated that the present invention also covers those modified and changed invention.

For example, the die plate 4 shown in FIG. 5 is not limited to the one in the H shape in plan view, and the shape is not particularly limited. The die plate 4 may be, for example, a plate member in a shape of quadrate such as a square and a rectangle or in another polygonal shape.

Additionally, the base member 5 shown in FIGS. 5 and 6 may be anything as long as the base member 5 supports the die plate 4 from below, and it is not limited to the one in a quadrangular frame shape. The base member 5 may be, for example, two pieces of quadrangular plate-shaped members that support two edge portions in the front and rear or two edge portions in the right and left of the die plate 4.

In this case, the two pieces of the quadrangular plate-shaped members may be arranged to be fixed on upper ends of the front and rear guide support poles 35 or to be fixed on upper ends of the right and left guide support poles 35.

Moreover, a mechanism for floatingly supporting the die plate 4 is not limited to the one formed of the step portion 5*c* on the upper side inner edge of the insertion portion 5*b* and the engagement portion 4*b* supported by the step portion 5*c* so that the die plate 4 can be moved by a predetermined range in the horizontal direction.

For example, the floatingly supporting mechanism may be formed of multiple clamp protrusions provided to project from the upper side edge portions of the insertion portion 5*b* of the base member 5 and clamp engagement holes to which the clamp protrusions are loosely fit respectively.

In this case, the clamp protrusions are protrusions for supporting that support the die plate 4 at predetermined positions by being inserted in the clamp engagement holes. The clamp protrusions are formed of rod-shaped protrusions projecting upward from the upper surface of the base member 5.

Each clamp engagement hole may be formed to have the radius greater by the length of the clearance S1 than the radius of the clamp protrusion so as to support the die plate 4 movably in the front, rear, right, and left directions by the length of the clearance S1 when the clamp protrusion is engaged with the clamp engagement hole.

REFERENCE SIGNS LIST

1 mold casting device
2 mold
3 raising and lowering mechanism
4 die plate
5 base member
5*a* support portion
5*b* insertion portion
5*c* step portion
6 gauge head
8 pull-up device
21 upper mold
22 lower mold
41 hanging portion

The invention claimed is:

1. A mold casting device that obtains a casting product by pouring a melt into a cavity formed between an upper mold and a lower mold, comprising:

a raising and lowering mechanism having a guide support pole that raises and lowers the upper mold;

a die plate that is fixed to the upper mold;

a base member that is provided on the guide support pole and supports the die plate from below; and a gauge head that gauges a displacement of the die plate due to a thermal expansion of the upper mold, wherein the base member includes a support portion that supports the die plate and an insertion portion through which the upper mold fixed on the die plate is inserted upward and downward, on an upper side inner edge of the insertion portion, a step portion that supports the die plate movably by a predetermined range in a horizontal direction is formed, and the die plate is raised above an upper surface of the step portion and floatingly supported by the base member relatively movably with respect to the base member.

2. The mold casting device according to claim 1, wherein the die plate includes a plurality of hanging portions to be coupled with hooks of pull-up devices that pull up the die plate.

* * * * *